US005279500A

United States Patent [19]

Perrin et al.

[11] Patent Number: 5,279,500

[45] Date of Patent: Jan. 18, 1994

[54] APPARATUS FOR SPREADING A ROAD SURFACING MATERIAL

[75] Inventors: Michel Perrin, Noisy le Grand; Jean-Pierre Reymonet, Le Chesnay; Clément Beatrix, Christo En Jarez; Pierre Defontaine, Nantes; Philippe Brissonneau, Peynier Rousset; Jean-Pierre Gravet, Rouffach, all of France

[73] Assignee: Colas S.A., Boulogne-Billancourt, France

[21] Appl. No.: 740,097

[22] Filed: Aug. 5, 1991

[30] Foreign Application Priority Data

Aug. 8, 1990 [FR] France ..... 90 10141

[51] Int. Cl.[5] ..... E01C 7/36

[52] U.S. Cl. ..... 404/75; 404/111

[58] Field of Search ..... 404/72, 75, 82, 83, 404/92, 101, 108, 111, 116, 94

[56] References Cited

U.S. PATENT DOCUMENTS

| | | | |
|---|---|---|---|
| 1,729,574 | 9/1929 | Finley | 404/111 X |
| 1,961,971 | 6/1934 | Ignace | 404/76 |
| 2,374,732 | 5/1945 | Colburn . | |
| 3,202,359 | 8/1965 | Gill, Jr. . | |
| 3,245,329 | 4/1966 | Nagin et al. | 404/75 |
| 3,596,577 | 8/1971 | Chennells | 404/76 X |
| 3,891,585 | 6/1975 | McDonald | 404/32 |
| 4,069,182 | 1/1978 | McDonald | 404/72 |
| 4,113,401 | 9/1978 | McDonald | 404/75 |
| 4,124,325 | 11/1978 | Cutler | 404/75 |
| 4,198,177 | 4/1980 | Ray, Jr. et al. | 404/75 |
| 4,226,552 | 10/1980 | Moench | 404/92 |
| 4,274,586 | 6/1981 | Hill . | |
| 4,423,980 | 1/1984 | Warnock | 404/83 |
| 4,453,856 | 6/1984 | Chiostri et al. | 404/111 X |
| 4,637,656 | 1/1987 | Medeot | 299/36 X |
| 4,676,690 | 6/1987 | Allen | 404/110 |
| 4,678,363 | 7/1987 | Sterner | 404/75 |
| 4,685,826 | 8/1987 | Allen | 404/114 |
| 4,971,467 | 11/1990 | Guillon | 404/92 X |

FOREIGN PATENT DOCUMENTS

| | | | |
|---|---|---|---|
| 0109303 | 5/1984 | European Pat. Off. . | |
| 8804709 | 6/1988 | European Pat. Off. | 404/76 |
| 0292337 | 11/1988 | European Pat. Off. . | |
| 0325533 | 7/1989 | European Pat. Off. . | |
| 8506280 | 4/1985 | Fed. Rep. of Germany . | |
| 8631626 | 2/1987 | Fed. Rep. of Germany . | |
| 243951 | 3/1987 | Fed. Rep. of Germany | 404/111 |
| 2573455 | 5/1986 | France . | |
| 2626593 | 8/1989 | France | 404/76 |
| 114974 | 9/1974 | German Democratic Rep. . | |
| 882725 | 11/1961 | United Kingdom . | |
| 1420736 | 1/1976 | United Kingdom . | |

*Primary Examiner*—Ramon S. Britts
*Assistant Examiner*—Roger J. Schoeppel
*Attorney, Agent, or Firm*—Sandler Greenblum & Bernstein

[57] ABSTRACT

Apparatus for spreading a fluid or like substance, for example, an emulsion for bonding bituminous coated material on the surface of a road including a mobile machine, at least one spreading bar along which the spreading is at least partially effected, and at least one ejection nozzle associated with the at least one spreading bar. A supply circuit supplying emulsion to the nozzle. The at least one nozzle is associated with a mechanism for controlling delivery of the emulsion and a mechanism for controlling positioning of the nozzle relative to the machine. Both of the mechanisms are operated simultaneously, in dependence on the movement of the mobile machine, in such a manner that the nozzle effects spraying by sequenced jets of the substance to continuously cover the surface which is to be spread. The machine provided with this apparatus is of the finisher type.

31 Claims, 3 Drawing Sheets

APPARATUS FOR SPREADING A ROAD SURFACING MATERIAL

FIELD OF THE INVENTION

The present invention relates to an apparatus for spreading a fluid or like substance, particularly an emulsion for bonding bituminous coating material on the surface of a road, as well as to a road construction machine, particularly of the finisher type, equipped with an apparatus of this kind.

DESCRIPTION OF THE PRIOR ART

It is known that the different layers of materials of which a road is composed (cement-bound sand and gravel, bituminous base course, bituminous coating material) are bonded by spreading a bonding emulsion before the top layer is applied. For a long time this emulsion layer was deposited before the passage of the finisher intended to apply the bituminous coating material, this being done with the aid of a spreader type machine comprising a tank and a spreading bar.

However, it was recently found, as has been stated in the document EP-A-292337, that this procedure entailed numerous disadvantages:

- road spreaders, which had a large bulkiness and a poor maneuverability, were not very suitable for urban work sites;
- in addition, the finisher was supplied with coating material by means of trucks, which by running over the unsurfaced bonding layer contributed, together with the crawler tracks of the finisher, towards the removal of part of the bonding layer as their wheels passed over the bonding layer precisely on those parts of the road surface which would subsequently be most heavily stressed by the loads applied by passing trucks;
- moreover, the trucks gave rise to soiling, which was both annoying and dangerous for users of the adjacent traffic lanes.

In particular, poor bonding systematically entails weakness in the structure of the road and earlier failure through fatigue.

It has thus been proposed, particularly in EP-A-292337 mentioned above, to deposit the bonding layer just before the application of the coating material by the finisher. The apparatus proposed by EP-A292337 associates the finisher with an independent frame mounted on running gear and moving in front of and at the same speed as the finisher, the frame serving to spread the bonding layer.

Nevertheless, this apparatus completely fails to prevent the crawler tracks of the finisher from running over the bonding layer precisely at those parts of the latter which will subsequently be the most heavily stressed. Moreover, and above all, the multi-apertured spreading bars used in conventional binder spreaders are in practice found to be completely unsuitable for this new apparatus; the usual amounts of binder, which are relatively small (300 grams per square meter to 1.2 kilograms per square meter), are spread over the ground by movement of the spreading bar at the speed of the finisher, that is to say a speed (from 3 to 6 meters per minute) much slower than that of conventional spreaders (from 30 to 100 meters per minute). This combination has to provide a very slight flow of binder, so that the apertures of conventional spreader nozzles are no longer suitable but must have a very small diameter; consequently they tend to clog because of the viscosity of the binders used.

SUMMARY OF THE INVENTION

The present invention seeks to obviate these various disadvantages.

For this purpose it provides an apparatus making it possible to spread the bonding emulsion by operating each nozzle in a sequenced manner in which spraying phases alternate with non-spraying phases. In this way the nozzles of the spreading bar of this apparatus are used, for an equal amount of binder on the ground, with higher ejection deliveries than are usual, thus making it possible to avoid the previously mentioned problems of clogging.

It will also be noted that the apparatus provided by the invention gives the advantage of being of sufficiently small bulkiness to be able to be placed at the rear of the finisher, behind the crawler tracks of the latter and between the tracks and the means for spreading bituminous coating material on the road.

The subject of the present invention is therefore an apparatus for spreading a fluid or like substance, for example, an emulsion for bonding bituminous coating material on the surface of a road, comprising, on a mobile machine, at least one spreading bar along which the spreading is at least partially effected, the bar being associated with at least one ejection nozzle as well as with a supply circuit for the nozzle, wherein the nozzle is associated with means which control its delivery and are operated, in dependence on the movement of the mobile machine, in such a manner that the nozzle effects spraying by sequenced jets of the substance onto the surface to be spread.

The nozzle is advantageously associated with means controlling its positioning relative to the machine, the means being operated simultaneously with the delivery control means of the nozzle in order to achieve, in conjunction with the advance of the mobile machine, an impact on the surface to be spread such that the surface is continuously covered; the positioning control means associated with a nozzle preferably comprise an actuator intended to drive the nozzle in a reciprocating pivoting movement about an axis of the mobile machine.

The delivery control means and positioning control means associated with a nozzle are preferably operated simultaneously in accordance with a predetermined cycle in which spraying phases alternate with non-spraying phases in dependence on the metering of the substance to be applied to the surface to be spread in the case of the means, and in dependence on the speed of the mobile machine in the case of the positioning control means.

The spreading bar advantageously comprises a plurality of nozzles distributed over its length, the height of the nozzles relative to the ground during the spreading and the distance between two adjacent nozzles being such that the sprayed impacts on the surface being spread, through the action of two adjacent nozzles, effect continuous covering of the surface.

It is also preferable for the control means associated with a nozzle to be provided with a closure means for the nozzle, which means is operated during the movement of the mobile machine to open and close alternately; in the case where the spreading bar comprises a plurality of nozzles, the control means associated with these nozzles are operated simultaneously.

It is likewise very advantageous for a nozzle to emit jets whose impact on a surface at right angles to the direction in which they are sprayed has a geometrical outline whose shapes may vary, being, in particular, a square or an ellipse. The sequencing of the spraying may be controlled by a microprocessor.

A nozzle is preferably mounted to pivot about an axis disposed substantially in a width of the mobile machine. During a spraying phase a nozzle may be driven to pivot about its axis between two end positions, the direction of the spraying by the nozzle of the substance onto the surface to be spread being away from the mobile machine in relation to the nozzle in one of these positions and towards the mobile machine in the other position. A nozzle may, in particular pivot, during a spraying phase, from one of its two end positions to the other with a pivoting direction coinciding with the direction of movement of the mobile machine.

It is in addition preferable for an actuator to drive in a pivoting movement at least one nozzle by means of a cardan joint and to be associated with positioning adjustments for the end and the starting of the pivoting; a spreading bar may also comprise a hollow tube intended to contain in its interior an amount of the substance and having a plurality of nozzles mounted on it, the hollow tube being connected to the supply circuit; the hollow tube may be mounted for pivoting about an axis of the finisher and is associated with driving means causing it to pivot; the supply circuit may comprise a flexible part enabling it to accompany the movements of said hollow tube; a spreading bar may be drawn by a heating wire with regulation of the spreading temperature of the substance.

A spreading bar may comprise a main part extending over substantially one base width of the mobile machine and secondary parts adapted to be disposed one on each side of said base width.

Another subject of the invention is a road construction machine of the finisher type comprising, on a frame mounted on running gear, means for spreading bituminous coating material and supply means for said spreading means, which machine comprises an apparatus of the type previously described for spreading over the surface of a road an emulsion for bonding the coating material.

The apparatus spreading a bonding emulsion is preferably disposed at the rear of the frame, relative to the direction of movement of the machine in the course of the spreading of the coating material; the apparatus spreading a bonding emulsion is disposed between the running means of the machine and the means for spreading bituminous coating material; the apparatus spreading a bonding emulsion is disposed under that part of the supply means which is situated at the rear of the frame, relative to the direction of movement of the machine during the spreading of the coating material. Moreover, when the supply means comprise a supply belt enabling the materials to be conveyed from a zone near the front part of the machine to a zone near the rear part, the supply belt is substantially raised and/or inclined at its rear part, just above the bonding emulsion spreading means.

Additionally, it is advantageous for the machine to be provided with an emulsion tank mounted on the operator's cab, which can include an interchangeable tank is mounted on hydraulic height control jacks. The emulsion tank may have thermal insulation. The machine can also include an emulsion metering unit which has a metering pump feeding the supply circuit and the machine can be provided with a control unit enabling the delivery and closure of the binder feed system to be made dependent on the movement and the speed of the machine. Further, the spreading apparatus associated with the machine is adapted to be rapidly disconnected from the frame of the machine.

BRIEF DESCRIPTION OF THE DRAWINGS

The invention will be further illustrated, without in any way being limited, by the following description, which is given with reference to the accompanying drawings, in which.

DESCRIPTION OF PREFERRED EMBODIMENTS

Figure 1:
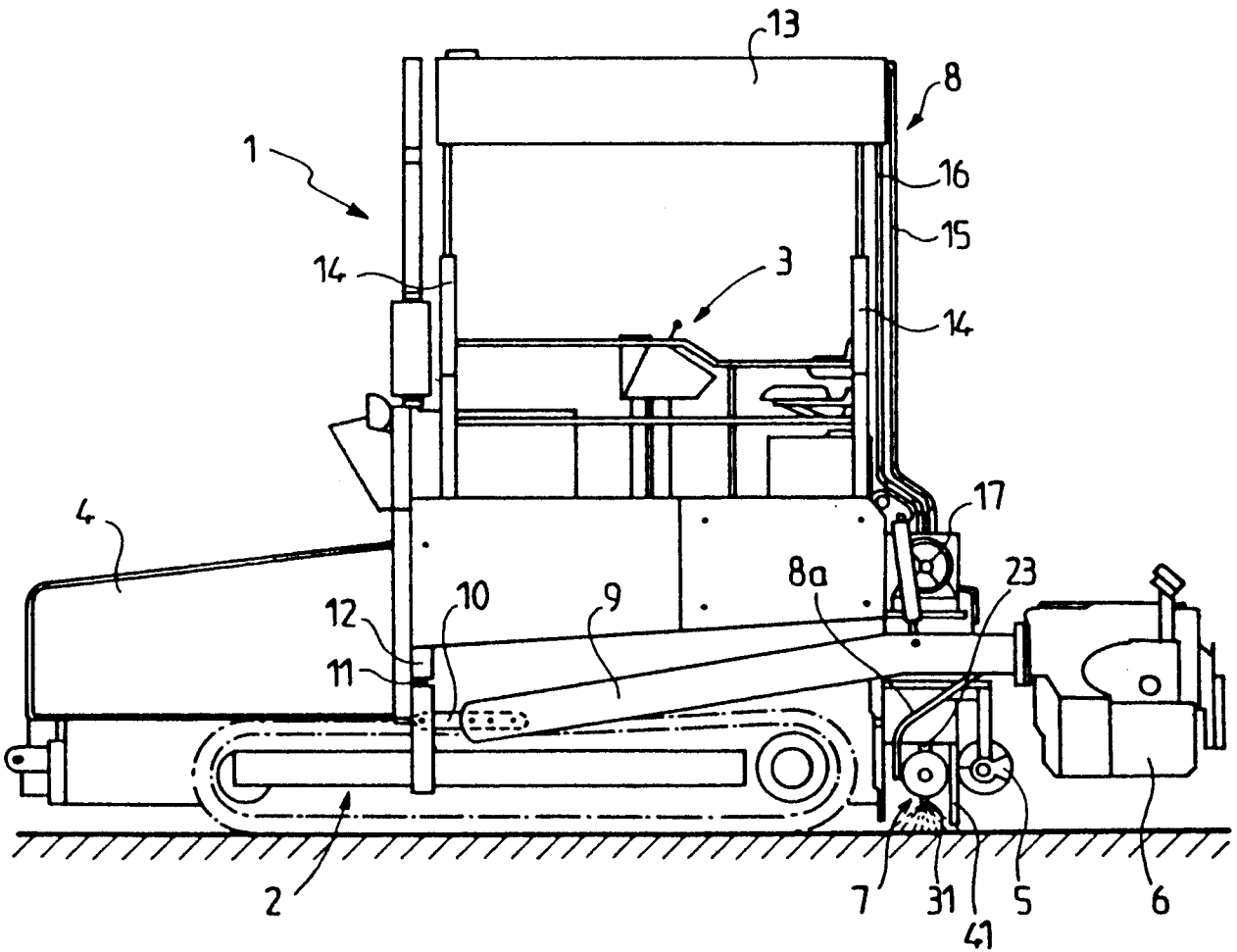
FIG. 1 is a side view of a finisher type machine equipped with a spreading apparatus according to the invention.

Referring more particularly to FIG. 1, it can be seen that a finisher type machine according to the invention, given the general reference 1, is mounted on crawler tracks 2 and comprises essentially an operator's cab 3, a hopper 4 holding bituminous coating material and disposed at the front of the finisher, conventional means 5 for spreading bituminous coating material, the means 5 consisting in particular of a distributor screw and being disposed at the rear of the finisher 1, a table 6 for smoothing the deposited layers of coating material, and also a bonding emulsion spreading apparatus 7 associated with an emulsion supply circuit given the general reference 8.

The hot bituminous coated material is transferred in conventional manner from the hopper 4 to the coating material spreading means 5 with the aid of a transfer belt (not shown) disposed on the finisher 1 between the cab 3 and that part of the finisher which carries the crawler tracks 2. This belt is slightly raised at its rear part above the spreading means 7. The smoothing table 6 is mounted at the rear of the finisher 1, further back than the coating material spreading means 5, on two bent arms 9 extending one on each side of the machine, substantially from the middle of the crawler tracks to a point beyond the spreading means 5. These two arms 9 are pivoted, at their end opposite the smoothing table 6, on cross-bars 10 mounted in the vicinity of the crawler tracks 2, the inclination of the arms 9 relative to the plane of the ground determining the height of the smoothing table 6 and being adjusted by means of jacks 11, each of which extends between a mounting point on the cross-bar 10 and a mounting point 12 on the side of the finisher frame in line with the floor of the cab 3, at the rear of the latter.

The supply circuit 8 comprises essentially an emulsion tank 13 the capacity of which is greater than 2500 liters. This tank 13 is disposed above the cab 3 and extends substantially over the entire length of the latter. It is mounted on four hydraulic lifting jacks 14 extending at right angles to the floor of the cab 3, in positions close to each of the four ends of the floor. These jacks 14 make it possible to adjust at will the height of the tank 13 on the finisher 1, the tank 13 being able, for example, to assume a high position of use and a low storage position facilitating the transport of the finisher 1. This tank 13 is a "cartridge"-type container which can be replaced during operation. If required, the walls of this tank 13 are provided with valve apertures intended to cooperate with the male ends of pipes 15 and 16, which are supply and return pipes connecting the tank 13 to a bonding emulsion metering unit 17 providing delivery and pressure. The tank 13 is in addition a thermally insulated tank which can be equipped with a temperature maintaining heating system, for example, an electrical system.

Figure 2:
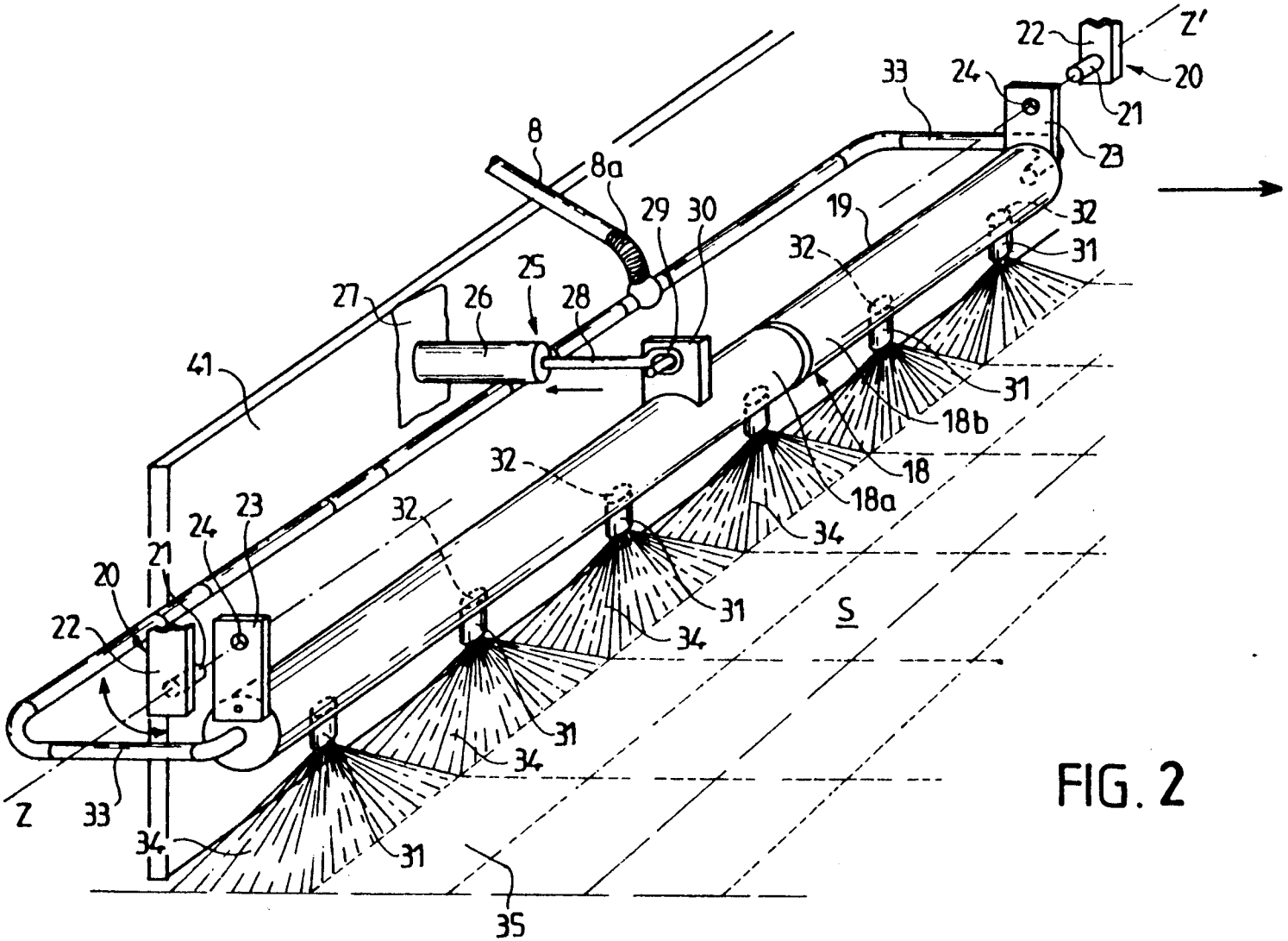
FIGS. 2 and 3 show schematically in perspective the spreading apparatus with which the finisher shown in FIG. 1 is equipped, in two different positions in the course of the kinematics of the spreading operation.
Figure 3:
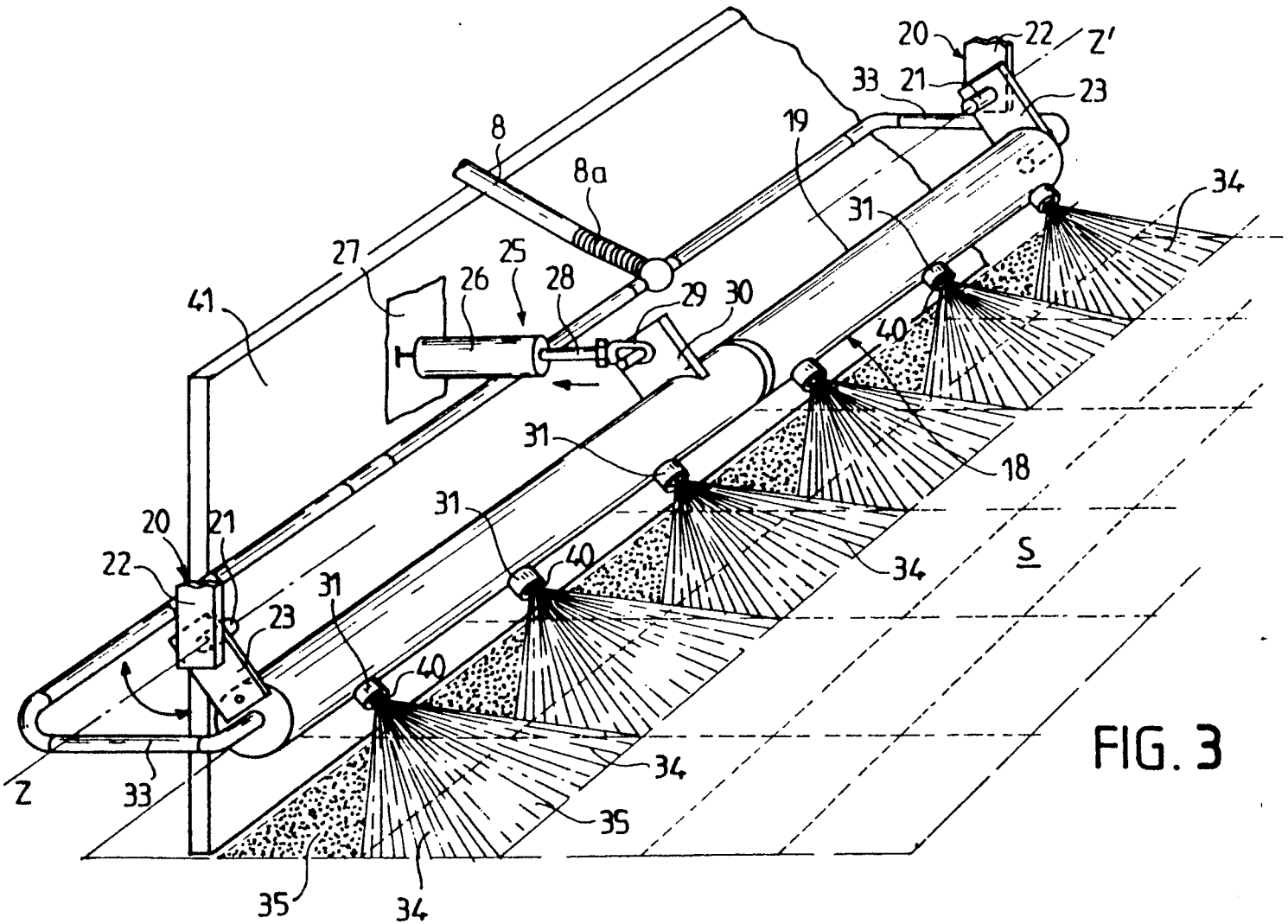

Referring more particularly to FIGS. 2 and 3, it can be seen that the binder spreading apparatus 7 according to the invention comprises a spreading bar 18 intended for spreading the binder over the base width of the finisher 1. Right-hand and left-hand extensions (not shown) can be provided on each side of the base width.

The bar 18 comprises essentially a hollow cylindrical tube 19 extending substantially over the entire base width of the finisher 1. The tube 19 is fixed on the finisher 1 with the aid of pivoting means consisting, at each end of the tube 19, of a pivot rod 21 fastened to a support 22 which is stationary relative to the finisher 1, each pivot rod 21 cooperating for a pivoting action with a hole 24 provided in two lugs 23 integral with the tube 19 at the respective ends of the latter. The two pivot rods 21 thus defined are disposed on the same axis ZZ', about which the tube 19 is pivotable through the action of control means given the general reference 25. The control means 25 comprise essentially an actuator 26 whose body 27 is adjustable relative to the finisher 1 and whose movable, adjustable rod 28 acts with the aid of a cardan joint 29 on a shoulder 30 integral with the tube 19.

The hollow tube 19 is associated at each end with a pipe 33, which connects it to the supply circuit 8, in particular, with the aid of a flexible part 8*a* enabling the pipe 33 to accompany the tube 19 in its pivoting movements about the axis ZZ'.

The spreading bar 18 comprises a plurality of ejection nozzles 31 (for example 8 to 10 nozzles over a width of 2.50 meters). Each of these nozzles 31 extends from the tube 19 at right angles to the axis ZZ' towards the ground, and is associated with a closure means 32, which, for example, comprises in conventional manner a set screw pushed back into an opening in the corresponding nozzle 31 by means of a helical spring. These various closure means 32 are all mechanically operated simultaneously. Each nozzle 31 has an aperture suitable for spraying the bituminous substance, thus making it possible to obtain jets 34 whose impact on a surface at right angles to the spraying direction has an outline which is substantially either a square or an ellipse. The different elements of the apparatus, particularly the closure means 32, are controlled by a microprocessor (not shown).

The spreading bar 18 is in addition separated from the coated material spreading means 5 by means of a wall 41 serving as deflector for the jets 34 and extending over the entire base width of the finisher 1 and substantially to the level of the ground S.

An apparatus of this kind operates in the manner which will now be described. The closure means 32, which serve as control means for the nozzles 31, are operated cyclically to open and close the nozzles 31 alternately. During the open phase of the nozzles 31, the entire tube 19 is driven by the actuator 25 in a pivoting movement about the axis ZZ', thus passing from a cycle starting position shown in FIG. 2, where the jets 34 extend from the tube 19 towards a part of the ground distant from the finisher 1, to an end of cycle position shown in FIG. 3, where the jets 34 extend from the ends of the nozzles 31 to a part of the ground closer to the crawler tracks 2 of the finisher 1. Thus, during a spraying phase of the nozzles 31 each jet covers on the ground S a zone 35 which is swept over by the jet 34 in its movement resulting from the combination of the advance of the finisher 1 and the pivoting of the tube 19 about the axis ZZ', the direction of movement of the finisher 1 being indicated in FIGS. 2 and 3 by the main arrow.

During the non-spraying phase (nozzles 31 closed by their closure means 32) which follows this open phase, the finisher 1 continues to move at the same speed, while the spreading bar 18, operated by the actuator 25, pivots about the axis ZZ' so as to assume once again, relative to the finisher 1, a position corresponding to that shown in FIG. 2.

The advance of the finisher 1 during this non-spraying phase and the pivoting return movement of the spreading bar 18 are coordinated by the microprocessor in such a manner that the nozzles 31 resume spraying during the following phase, thus achieving, in conjunction with the preceding impact, a continuous covering of the road surface, the impacts of two successive spraying phases forming continuations of one another.

In addition, the distance between two adjacent nozzles 31 on the bar 18 and the height of the nozzles 31 in relation to the ground during the spreading are previously determined in such a manner that continuous covering is also achieved over the width of the finisher 1.

What is claimed is:

1. Apparatus for spreading a fluid or like substance including an emulsion for bonding bituminous coated material on a surface of a road, comprising:

a mobile machine;

at least one spreading bar on said mobile machine along which spreading is at least partially effected;

at least one ejection nozzle associated with said at least one spreading bar;

a supply circuit to supply a substance to be spread to said at least one ejection nozzle; and a controlling mechanism for controlling delivery of the substance through said at least one ejection nozzle to cyclically spray the substance during movement of said mobile machine in dependence upon movement of said mobile machine to effect, during movement of the mobile machine, sequenced spraying and non-spraying of the substance through said at least one ejection nozzle to spray at least one sequenced jet of the substance to continuously cover the surface.

2. The apparatus according to claim 1, including a mechanism for controlling positioning of said at least one ejection nozzle, said mechanism for controlling positioning capable of being operated simultaneously with said controlling mechanism to achieve, in conjunction with advance of said mobile machine, an impact on the surface to be spread to continuously cover the surface.

3. The apparatus according to claim 2, wherein said at least one ejection nozzle is pivotally mounted about an axis disposed substantially in a width of said mobile machine.

4. The apparatus according to claim 3, wherein, during a spraying phase, said at least one ejection nozzle is driven to pivot about said axis between two end positions, the direction of spraying by said at least one ejection nozzle of the substance onto the surface being away from said mobile machine in relation to said at least one ejection nozzle in one of said two end positions and towards said mobile machine in the other of said two end positions.

5. The apparatus according to claim 4, wherein said ejection nozzle pivots, during a spraying phase, from one of said two end positions to the other with a pivoting direction coinciding with direction of movement of said mobile machine.

6. The apparatus according to claim 4, wherein said mechanism for controlling positioning of said at least one ejection nozzle comprises an actuator for pivoting said at least one ejection nozzle by a cardan joint, said actuator being associated with positioning adjustments for end and starting of pivoting.

7. The apparatus according to claim 6, including a heating wire for regulating temperature of the substance within said at least one spreading bar.

8. The apparatus according to claim 2, wherein said mechanism for controlling positioning comprises an actuator for driving said at least one ejection nozzle in a reciprocating pivoting movement about an axis of said mobile machine.

9. The apparatus according to claim 2, wherein said controlling mechanism and said mechanism for controlling positioning are capable of simultaneous operation in accordance with a predetermined cycle in which spraying phases alternate with non-spraying phases in dependence on metering of the substance for said controlling mechanism, and in dependence on speed of said mobile machine for said mechanism for controlling positioning.

10. The apparatus according to claim 2, wherein said at least one ejection nozzle comprises a plurality of ejection nozzles distributed over the length of said at least one spreading bar, said plurality of ejection nozzles having a height with respect to the surface and a distance between two adjacent nozzles so that continuous covering of the surface is effected by adjacent ejection nozzles.

11. The apparatus according to claim 1, wherein said controlling mechanism comprises at least one closure element for said at least one ejection nozzle, said at least one closure element being operated during movement of said mobile machine to alternately open and close a corresponding at least one ejection nozzle.

12. The apparatus according to claim 1, wherein said at least one ejection nozzle comprises a plurality of ejection nozzles, and said controlling mechanism is capable of simultaneously permitting flow of the substance through said plurality of ejection nozzles.

13. The apparatus according to claim 1, wherein said at least one ejection nozzle emits a jet whose impact on a surface at right angles to the direction of spray has a variable geometrical outline.

14. The apparatus according to claim 13, wherein said geometrical outline comprises a square or an ellipse.

15. The apparatus according to claim 1, wherein said controlling mechanism comprises a microprocessor for controlling sequencing of the spraying.

16. The apparatus according to claim 1, wherein said at least one spreading bar comprises at least one hollow tube having an interior capable of containing an amount of the substance, said at least one ejection nozzle being mounted on said at least one hollow tube, and said hollow tube being connected to said supply circuit.

17. The apparatus according to claim 16, wherein said at least one hollow tube is mounted for pivoting about an axis of a finisher, and is associated with a driving mechanism to effect pivoting of said at least one hollow tube.

18. The apparatus according to claim 17, wherein said supply circuit comprises a flexible part enabling said supply circuit to accompany movements of said at least one hollow tube.

19. The apparatus according to claim 1, wherein said at least one spreading bar comprises a main part extending over substantially one base width of said mobile machine, and secondary parts adapted to be positioned one on each side of said base width.

20. A road construction finisher apparatus, comprising:

a frame mounted for movement;

means for spreading bituminous coating material;

means for supplying said means for spreading; and a device for spreading a substance for bonding bituminous coating material on a surface of a road, said device comprising:

at least one spreading bar;

at least one ejection nozzle associated with said at least one spreading bar;

a supply circuit to supply the substance to said at least one ejection nozzle; and a controlling mechanism for controlling delivery of the substance through said at least one ejection nozzle to cyclically spray the substance during movement of said frame in dependence upon movement of said frame to effect, during movement of said frame, sequenced spraying and non-spraying of the substance through said at least one ejection nozzle to spray at least one sequenced jet of the substance to continuously cover the surface.

21. The apparatus according to claim 20, wherein said device is positioned at a rear portion of said frame, relative to direction of movement of the apparatus during spreading of the coating material.

22. The apparatus according to claim 21, wherein said frame is mounted on running gear, and said device for spreading a substance for bonding bituminous coating material is positioned between said running gear and said means for spreading bituminous coating material.

23. The apparatus according to claim 22, wherein said device is positioned under that part of said means for supplying that is situated at the rear portion of said frame, relative to center of movement of the apparatus during spreading of coating material.

24. The apparatus according to claim 23, wherein means for supplying comprise a supply belt enabling material to be conveyed from a zone near a front part of the frame to a zone near said rear portion, wherein said supply belt is substantially raised at a rear section, just above said device.

25. The apparatus according to claim 24, wherein said supply belt is inclined at said rear section.

26. The apparatus according to claim 23, wherein means for supplying comprise a supply belt enabling material to be conveyed from a zone near a front part of the frame to a zone near said rear portion, wherein said supply belt is substantially inclined at a rear section, just above said device.

27. The apparatus according to claim 20, including an operator cab's, and a tank for containing the substance is mounted on said operator's cab.

28. The apparatus according to claim 27, wherein said tank comprises an interchangeable tank mounted on hydraulic height control jacks.

29. The apparatus according to claim 20, including a thermally insulated tank for containing the substance.

30. The apparatus according to claim 20, comprising a substance metering pump unit including a metering pump feeding said supply circuit.

31. The apparatus according to claim 20, wherein said device is constructed and arranged to be disconnected from said frame.

* * * * *